US005832434A

United States Patent [19]

Meredith

[11] Patent Number: 5,832,434

[45] Date of Patent: Nov. 3, 1998

[54] METHOD AND APPARATUS FOR AUTOMATIC ASSIGNMENT OF DURATION VALUES FOR SYNTHETIC SPEECH

[75] Inventor: Scott E. Meredith, San Francisco, Calif.

[73] Assignee: Apple Computer, Inc., Cupertino, Calif.

[21] Appl. No.: 784,369

[22] Filed: Jan. 17, 1997

Related U.S. Application Data

[62] Division of Ser. No. 452,597, May 26, 1995, abandoned.

[51] Int. Cl.[6] ..... G10L 5/02

[52] U.S. Cl. ..... 704/260; 704/266; 704/258; 704/267

[58] Field of Search ..... 395/2, 2.67, 2.69, 395/2.74, 2.75, 2.76, 2.77; 704/200, 258, 260, 265, 266, 267

[56] References Cited

U.S. PATENT DOCUMENTS

| | | | |
|---|---|---|---|
| 3,704,345 | 11/1972 | Coker et al. | 704/266 |
| 4,278,838 | 7/1981 | Antonov | 704/260 |
| 4,709,390 | 11/1987 | Atal et al. | 704/262 |
| 4,964,167 | 10/1990 | Kunizawa et al. | 704/260 |
| 4,987,596 | 1/1991 | Ukita | 704/239 |
| 5,097,511 | 3/1992 | Suda et al. | 704/261 |
| 5,278,943 | 1/1994 | Gasper et al. | 704/200 |

*Primary Examiner*—David R. Hudspeth
*Assistant Examiner*—Vijay B. Chawan
*Attorney, Agent, or Firm*—Carr & Ferrell LLP

[57] ABSTRACT

The present invention automatically determines sound duration values, based on context, for phonetic symbols which are produced during text-to-speech conversion. The context-dependent and static attributes of the phonetic symbols are checked and specified. Then, the phonetic symbols are processed by a set of sequential duration-specification rules which set the duration value for each phonetic symbol.

18 Claims, 6 Drawing Sheets

350

| 510 | 520 |
| --- | --- |
| Segment is a vowel and segment is stressed | 3 |
| Segment is in a sentence-final syllable | 4 |

FIG. 5

METHOD AND APPARATUS FOR AUTOMATIC ASSIGNMENT OF DURATION VALUES FOR SYNTHETIC SPEECH

This is a division of application Ser. No. 08/452,597, filed on May 26, 1995, abandoned.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CROSS REFERENCE TO RELATED APPLICATIONS

This application is related to co-pending patent application having Ser. No. 08/008,958, entitled "METHOD AND APPARATUS FOR SYNTHETIC SPEECH PROSODY DETERMINATION," having the same inventive entity, assigned to the assignee of the present application, and filed with the United States Patent and Trademark Office on the same day as the present application.

This application is related to co-pending patent application having Ser. No. 08/007,306, entitled "INTERFACE FOR DIRECT MANIPULATION OF SPEECH PROSODY," having the same inventive entity, assigned to the assignee of the present application, and filed with the United States Patent and Trademark Office on the same day as the present application.

FIELD OF THE INVENTION

The present invention relates to the field of synthetic speech generation. More particularly, the present invention relates to automatically assigning duration values to a given synthetic utterance.

BACKGROUND OF THE INVENTION

Intonation (or 'prosody' as it's often referred to in the art), as provided for in most text-to-speech systems, generally has three components: 1) the pitch of the synthetic voice (roughly corresponding to vocal fold vibration rates in natural speech); 2) the duration of speech segments (e.g., how long the 'AE' is in the phonetic symbol sequence 'k.AE.t' derived from the text input 'cat'); and 3) the location and duration of any pauses (silence) that may be inserted in a given synthetic speech stream.

Text-to-speech systems usually incorporate rules that attempt to predict natural intonational attributes that are in harmony with the nature of text submitted for synthetic output. However, these rule systems are severely constrained in the current state of the art by the lack of sufficiently powerful language understanding mechanisms.

Text-to-speech systems commonly accept words in ordinary English orthography, such as "cat." The words are converted to phonetic symbols by dictionary look-up or by applying rules that convert the word letter-by-letter into phonetic symbols (resulting in e.g. "k.AE.t"). At this level, these phonetic symbols are abstractions. However, in order to render the output speech in a physical form, the sound represented by each phonetic symbol must be played by the system's speaker for a certain length of time. Milliseconds (ms) are generally used as appropriate units for time specification of phonetic speech segments. There is, however, no single set duration that will be perceptually appropriate for every segment in every context. Therefore, different duration values must be specified for any given segment, depending upon context.

There are a number of contextual factors that are commonly known to influence duration of speech segments, e.g. whether or not a segment is at the end of a word, phrase, or sentence; whether or not a vowel is followed by a voiced segment; whether a vowel is stressed or particularly emphasized; etc. Thus, phonetic symbols have duration values assigned by a system which can take into account a number of (potentially overlapping) contextual effects. The exact determination of the magnitude of different effects, the limitations of duration variation, etc., are an ongoing research project throughout the speech research community.

Various rule systems for calculating the duration of phonetic symbols in synthetic speech generation are known in the art. One prior approach known in the art, like the approach of the present invention, is also based on analysis of common factors that are known to influence the duration of phonetic symbols. This prior approach requires little memory or Random Access Memory (RAM) storage, but requires more mathematical calculation than the approach of the present invention. In addition, rule interaction is far more complex, and the rule system is correspondingly difficult to debug and extend as compared to the present invention.

At the opposite extreme, one can imagine a system that simply stores the appropriate duration in a table, one entry for every phonetic symbol in every possible relevant context. The present inventor is not aware of such a system having been proposed, but in any case it would be inferior to the approach of the present invention because it would require much more RAM storage during runtime processing.

Thus, approaches for specifying duration can range from extremes of a great deal of runtime calculation (like the prior approach referred to above), to prestoring almost every possible context and the appropriate final duration value for each context. The current approach uses very little storage and very little runtime calculation, to produce results of quality comparable to the computationally more expensive prior approach.

We can compare the approach of the present invention to the prior approach referred to above with respect to both computational expense and ease of understanding, debugging, and extending of rule sets. The prior approach uses a table of two initial values for each phonetic symbol: a minimum duration (MINDUR) and an 'inherent duration' (INHDUR). The actual final duration calculated can sometimes be less than the 'minimum' and sometimes greater than the inherent duration. Complete duration processing determination occurs one symbol at a time, and consists of the application of an ordered set of sequential rules. The system initially sets a variable PRCNT to 100. Then the rule set is applied, one rule at a time. Every rule that is triggered (is found to apply to the given phonetic symbol), based on context, results in PRCNT being updated according to the calculation:

$$PRCNT=(PRCNT*PRCNT1)/100,$$

where the value of PRCNT1 is given in the triggered rule. A typical rule would be:

"Consonants in non-word-initial position are shortened by

PRCNT1=85"

So, using the above formula, PRCNT would become 85 instead of 100. Basically, the rules calculate what percentage of the inherent duration (a value above the minimum) should be used for the symbol in a given context. At the end of the rule set, PRCNT is used in the final equation for actual duration (DUR) calculation:

$$DUR=((INHDUR-MINDUR)*PRCNT)/100+MINDUR.$$

So the prior approach, because it is based on a percentage determination, requires at least a multiply at every rule firing. Furthermore, if the prior approach is implemented according to the equations given, a divide is necessary as well. In addition, the effects of the given rules are much harder to understand because they are buried within these nested calculations, so the prior approach is correspondingly difficult to maintain and extend from an initial implementation.

SUMMARY AND OBJECTS OF THE INVENTION

It is an object of the present invention to determine duration values for phonetic symbols in a synthetic speech system.

It is a further object of the present invention to determine duration values for phonetic symbols in a synthetic speech system in a computationally efficient manner.

It is a still further object of the present invention to determine duration values for phonetic symbols in a synthetic speech system in a two phase manner.

The foregoing and other advantages are provided by a method for phonetic symbol duration specification in a synthetic speech system comprising determining context-dependent and static attributes of one or more phonetic symbols and setting the duration value for the one or more phonetic symbols based upon a set of duration determination rules.

The foregoing and other advantages are also provided by an apparatus for phonetic symbol duration specification in a synthetic speech system comprising means for determining context-dependent and static attributes of one or more phonetic symbols and means for setting the duration value for the one or more phonetic symbols based upon a set of duration determination rules.

Other objects, features and advantages of the present invention will be apparent from the accompanying drawings and from the detailed description which follows.

BRIEF DESCRIPTION OF THE DRAWINGS

The present invention is illustrated by way of example and not limitation in the figures of the accompanying drawings, in which like references indicate similar elements, and in which:

FIG. 5 is a block diagram illustrating details of the duration rule table of FIG. 3.

DETAILED DESCRIPTION OF THE INVENTION

Figure 1:
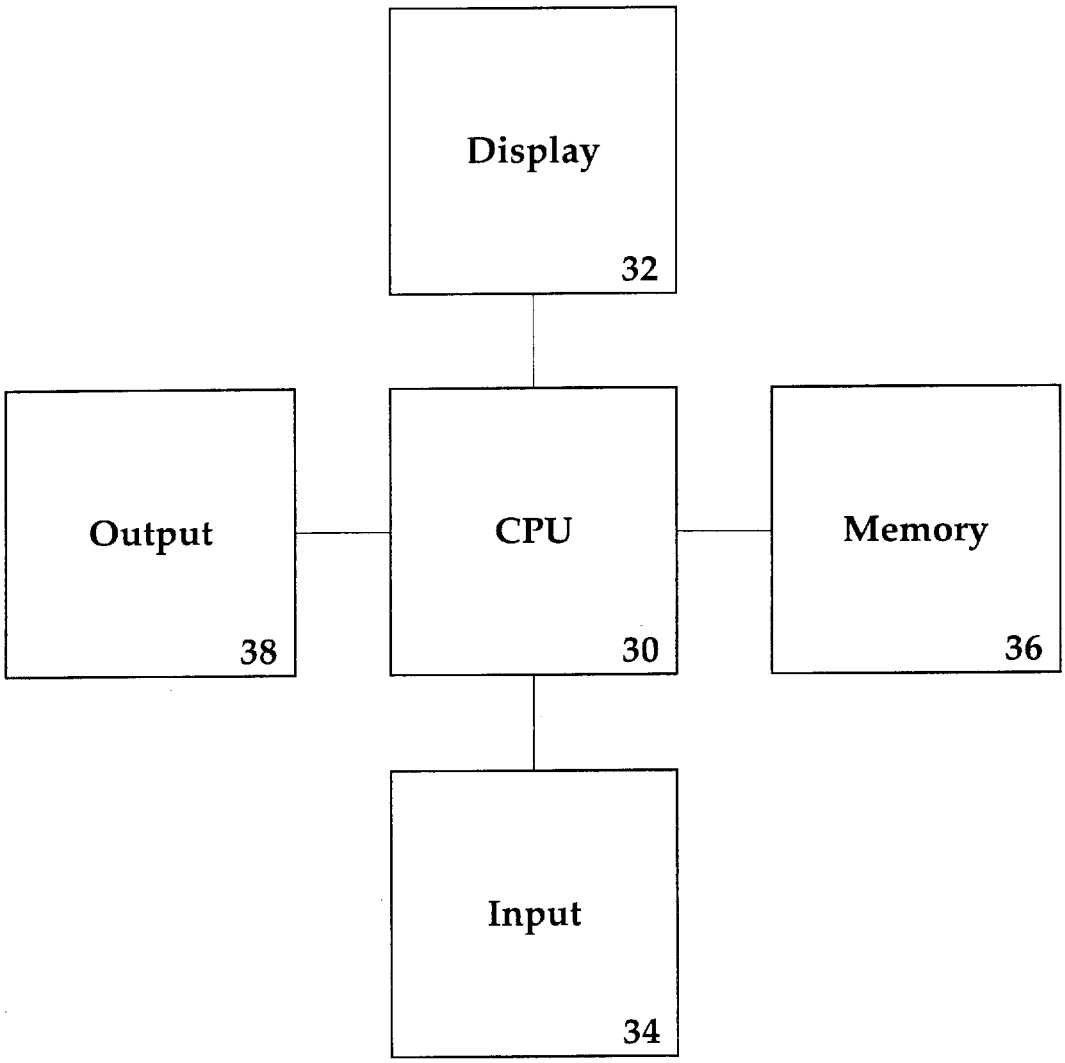
FIG. 1 is a block diagram of a computer system of the present invention.

The invention will be described below by way of a preferred embodiment as an improvement over the aforementioned text-to-speech systems, and implemented on an Apple Macintosh® (trademark of Apple Computer, Inc.) computer system. It is to be noted, however, that this invention can be implemented on other types of computers. Regardless of the manner in which the present invention is implemented, the basic operation of a computer system embodying the present invention, including the software and electronics which allow it to be performed, can be described with reference to the block diagram of FIG. 1, wherein numeral 30 indicates a central processing unit (CPU) which controls the overall operation of the computer system, numeral 32 indicates an optional standard display device such as a CRT or LCD, numeral 34 indicates an optional input device which may include both a standard keyboard and a pointer-controlling device such as a mouse, numeral 36 indicates a memory device which stores programs according to which the CPU 30 carries out various predefined tasks, and numeral 38 indicates an optional output device which may include a speaker for playing the improved speech generated by the present invention.

The present invention automatically determines sound duration values, based on context, for phonetic symbols (phonetic symbols are markers that represent perceptually significant sounds of human speech) which are produced during text-to-speech conversion. Every text-to-speech system requires that duration be specified for speech sounds, in order to realize them physically.

Note that variations of 10 to 20 per cent of a speech segment's average duration (in a given sentence context) may be perceptible but are not crucial for qualitative distinctions. This insight, derived from speech research by the present inventor, motivates coarser granularity of duration calculation (compared to prior art approaches), and corresponding computational savings. This is particularly important for systems that are limited in memory and available processor speed, such as low-cost personal computers.

For duration specification in the present invention, an approach is used which minimizes storage requirements (RAM) and Central Processing Unit (CPU) usage. Each phonetic symbol is processed by a set of sequential duration-specification rules (explained more fully below). After rule processing, the phonetic symbol has received a duration, specified in milliseconds (ms).

The preferred embodiment of the present invention uses a particular set of initial default numerical values. However, note that any set could be used as the quantitative basis for the present approach. The present invention is a more efficient application of such values to runtime synthetic speech processing as compared to the prior art approaches.

Figure 2:
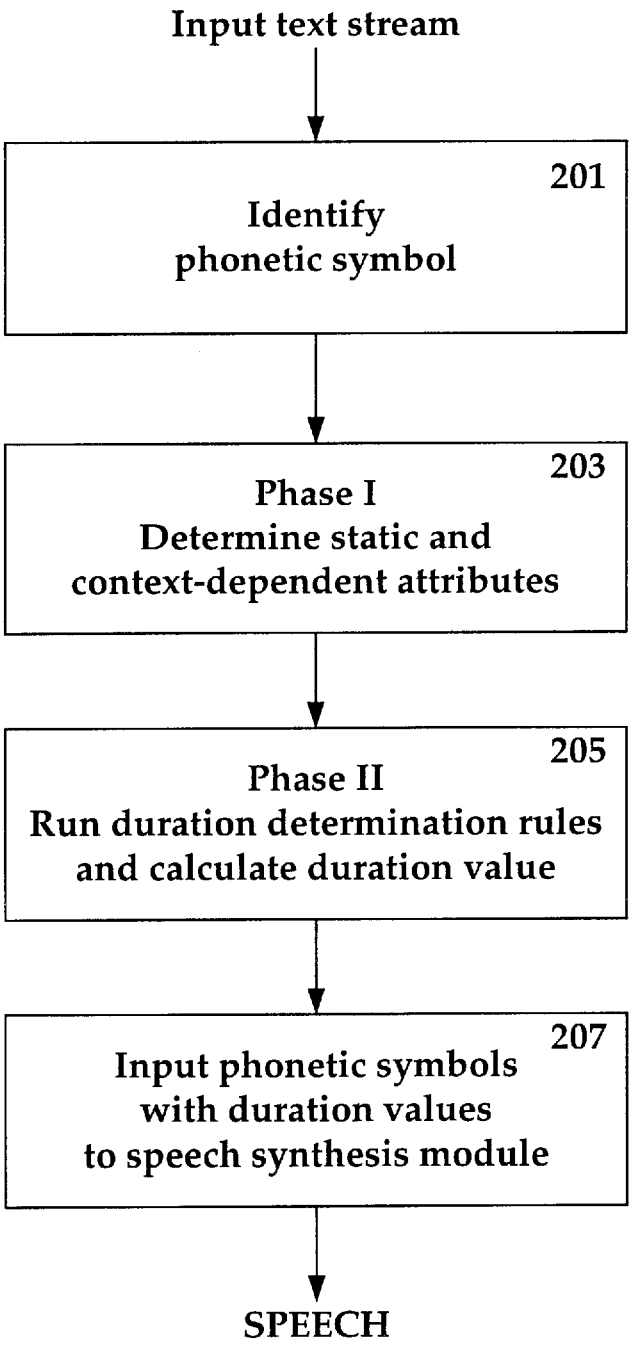
FIG. 2 is a flow chart of the approach of the present invention.

Referring now to FIG. 2, after phonetic symbols identification 201, each phonetic symbol from the input text stream is sequentially processed with the approach of the present invention. The following description concerns the processing of the preferred embodiment of the present invention as applied to a given single phonetic symbol. Initially, 203 the context-dependent attributes of the phonetic symbol are checked and specified along with the static attributes of each phonetic symbol of the input stream. In the preferred embodiment of the present invention, this is accomplished via a RAM-based table look-up function in conjunction with examination of attributes of neighboring phonetic symbols. In this way, the phonetic symbol is assigned a minimum duration and a maximum duration value. Further, the difference between the maximum and minimum duration is divided into 10 intervals or 'slots'.

Then, 205, a sequential set of rules determines, based on the contextual factors exemplified above, which slot number (1 through 10) is appropriate for the given symbol in context. The slot number is straight-forwardly related to an actual duration in milliseconds. In the preferred embodiment of the present invention, what is stored during run-time processing for each phonetic symbol is: minimum duration (MIN), maximum duration (MAX), difference and interval size (to save calculations at run-time). What must be calculated is merely: slot number (according to the rules), increment, and final duration.

An example follows:

input word: "bead", from input sentence "We bought a bead."

phonetic symbols: [b] [1IY][d]

Attributes assigned via table look-up and context examination (note that the "1" appearing in front of "IY" indicates that this vowel is stressed, as opposed to, for instance, the vowel "IY" in "shanty" ([S][1AE][n][t][IY])):

[b]: consonant, plosive, 1-stress, not-in-cluster, word-initial, in-mono-syllabic-word, part-of-speech=noun

[1IY]: vowel, 1-stress, in-mono-syllabic-word, part-of-speech=noun, left-context=consonant, right-context=voiced plosive

[d]: consonant, word-final, in-syllable-rime, not-in-cluster, in-mono-syllabic-word, part-of-speech=noun Duration is calculated for the symbol [1IY] in the center of "bead" as follows:

IY:
MIN=100 ms;
MAX=200 ms;
difference=100 ms;
interval (difference/10)=10.0 ms

In the preferred embodiment of the present invention, the 'slot number' for each phonetic symbol starts at 0. The slot number may be incremented, depending upon context, as identified by the rules. If no rule adds to the slot number, it remains at 0, and the minimum duration (MIN) from the table-lookup (100 ms, in this case) would be used. In practice, in the preferred embodiment of the present invention, there are several dozen rules (see Appendix B for a C code listing). Note that these rules may be varied according to the wishes of the implementor of the present invention. However, the factors which the rules are based upon generally do not vary (these factors can be seen in Appendix A). A simplified example of a typical rule might be:

IF {segment is a vowel} AND {segment is stressed}

THEN add 3 to slot number.

So, for example, if the slot number were 0 and the above rule triggered (as it would for [1IY] in "bead"), the slot number would be changed to 3. Additionally triggered rules might then further increase the slot number, if they were triggered by context, e.g.:

IF {segment is in a sentence-final syllable}

THEN add 4 to slot number.

The above rule would trigger for [1IY] in the sentence: "We bought a bead.", resulting in a slot number of 7 (=4+3) for the [1IY] of "bead" from the previous example.

Once all relevant rules have run (generally, when the end of the rule set has been reached), the slot number is fixed. Then the duration for the phonetic symbol in this example would be set as follows:

increment=(interval*slot number)=(10*7)=70;

duration=(MN+increment)=(100+70)=170

Further, note that, in the preferred embodiment of the present invention, setting the final duration value is still limited by the MAX value of the given phonetic symbol, and as such, in the preferred embodiment of the present invention, is not generally allowed to exceed that value except at very (unnaturally) slow rates of speech. Thus, if the given utterance is below the current system speech rate setting (which is one of the factors listed in Appendix A), this indicates that the desired intonation is much more pronounced (because the speaker is speaking very slowly which generally provides much greater emphasis to each phonetic symbol). Thus, the final duration value may actually be set above the original, default MAX value for a given phonetic symbol.

Still further, note that if the given utterance is above the current system speech rate setting, this indicates that the desired intonation is much less pronounced (because the speaker is speaking very quickly which generally provides much less emphasis to each phonetic symbol). In that case, the present invention further decreases the maximum (MAX) and minimum (MN) duration values utilized for the relevant phonetic symbols in order to provide that desired lesser emphasis. In this way, the final duration value may actually be set below the original, default MIN value for a given phonetic symbol.

The approach of the present invention has a number of desirable properties, particularly for personal computers having limited resources:

The memory usage is small. In the preferred embodiment of the present invention, the minimum (MIN) and maximum (MAX) duration for each phonetic symbol, plus the difference and interval values, are all that is stored in RAM (of course, not all of these values need to be stored because some of them can be derived from the others). These are short integers, and compression techniques could be used to reduce the storage further.

The runtime calculations are minimal—only simple integer additions are performed at each rule step, followed by a single multiply and addition at the final step. This saves processing time, particularly on less capable processors.

Effects of the rules and their interactions are easy to see. This makes rule enhancement, maintenance and debugging very easy.

An additional innovation of the present method is the explicit separation of the contextual analysis from the actual calculation of duration for each phonetic symbol. This can be done because the setting of context attributes requires a stretch of phonetic symbols of potentially arbitrary length, while once the context attributes are set, a phonetic symbol's final duration can be calculated without explicit reference to other phonetic symbols. This architecture is important because, for example, it allows asynchronous time-outs during the duration calculation phase, to permit other interleaved real-time processes (such as the actual speech playout) to operate as required.

An example of this 2-stage process using the same phonetic symbol [1IY] in the same context as the above example, will now be explained. Referring again to FIG. 2, the static and context-dependent attributes of [1IY] would be determined in the first phase 203. For this example, the context-dependencies are merely the following voiced consonant [d] and the fact that [1IY] is in a sentence-final syllable.

Phase 1: context-dependent attributes are checked and specified along with the static attributes of each phonetic symbol of the input. E.g.:

[1IY] {vowel, 1-stress, following consonant voiced, sentence final syllable}

In the preferred embodiment of the present invention, this phase is done for every phonetic symbol before any duration values are calculated.

Phase 2: duration determination rules are run 205 on each phonetic symbol (e.g. [1IY]) to set the duration value without the need to refer to any context beyond the individual phonetic symbol and its features.

This approach means that, during Phase 2 duration determination, any phonetic symbol attributes prior to the current symbol being processed need not be saved if an interrupt occurs. Also, any structural properties of the input sentence as a whole (such as whether it is an exclamation, etc.) need not be saved at interrupt time. Only the individual phonetic symbols and their individual attributes (which include context-dependent features) need be examined during the next rule processing phase for the next phonetic symbol.

The reason this is significant for real-time duration calculations, particularly in an asynchronous system, is that, in principle, context-dependent segments (the number of phonetic symbols of the input text stream analyzed for context dependencies) could be of unbounded length. If context-determination and duration calculation were both done completely for a single phonetic symbol before the next phonetic symbol's processing was begun, then no speech output could occur before the whole segment or sentence was completely processed. This could result in the speech from a previous segment or sentence running out before any more processed speech was available from the duration assignment module, and a perceptually damaging gap in sound output would result. In the preferred embodiment of the present invention, speech output can begin as soon as all contexts have been determined, and well before all duration values have been calculated. In fact, after the very first phonetic symbol's attributes have been determined and duration value has been calculated, it can be immediately output for playback.

Note that, in the preferred embodiment of the present invention, a segment (again, the number of phonetic symbols of the input text stream analyzed for context dependencies) is limited to a single sentence. Greater segment lengths could be used with the approach of the present invention provided that sufficient processing power was available. And lesser segment lengths could likewise be used, however, generally speaking, at least one sentence per segment is preferable in order to obtain enough contextual information.

Figure 3:
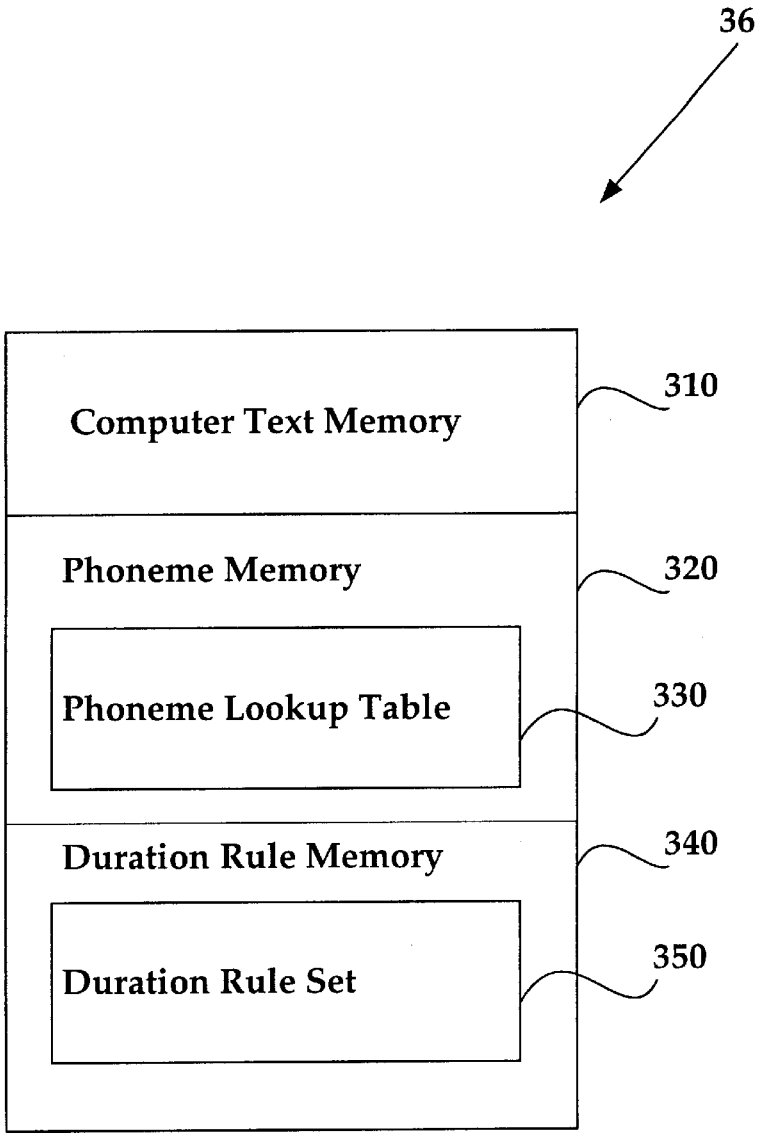
FIG. 3 is a block diagram illustrating details of the memory of FIG. 1.

FIG. 3 is a block diagram illustrating details of memory 36. Memory 36 comprises a computer text memory 310 for storing computer text to be spoken by the text-to-speech system. Memory 36 further comprises phoneme memory 320 storing a phoneme lookup table 330 which includes "computer text-to-phoneme" information and "phoneme-to-duration value data" information. Memory 36 further comprises duration rule memory 340, storing a duration rule set 350 which includes the duration rules and the duration slot values representing adjustments to the minimum (or maximum) duration value to compute the pronunciation duration value of the currently-considered phoneme.

Figure 4:
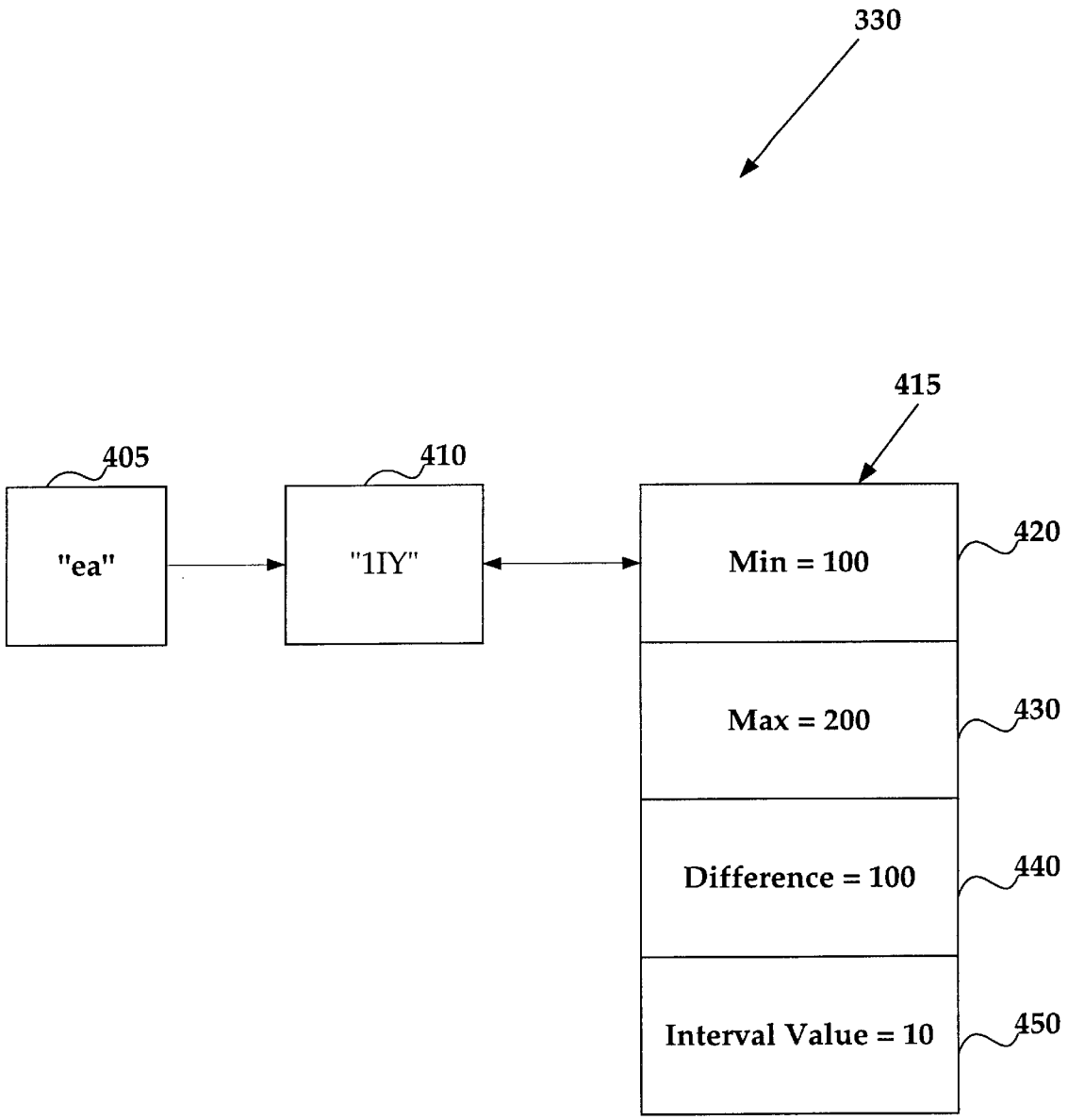
FIG. 4 is a block diagram illustrating the lookup table of FIG. 3.

FIG. 4 is a block diagram illustrating lookup table 330, which includes currently-considered computer text 405 that points to a corresponding phoneme 410. Phoneme 410 in turn corresponds to the duration value data 415, which includes a minimum duration value (e.g., "100") 420, a maximum duration value (e.g., "200") 430, the difference value between the maximum duration value and minimum duration value (e.g., "100") 440, and the duration interval value (e.g., "10") 450. Duration interval value 450 is computed by dividing difference value 440 by a predetermined number of intervals (e.g., "10").

FIG. 5 is a block diagram illustrating details of duration rule set 350, which includes duration rules 510 and, corresponding to each duration rule, slot numbers 520. A first example of a duration rule 510 includes a test whether a currently-considered segment is a vowel and whether the segment is stressed. This duration rule has a corresponding slot number 520 of three (3). A second example of a duration rule 510 includes a test whether a currently-considered segment is in a sentence-final syllable. This duration rule has a corresponding slot number 520 of four (4).

Figure 6:
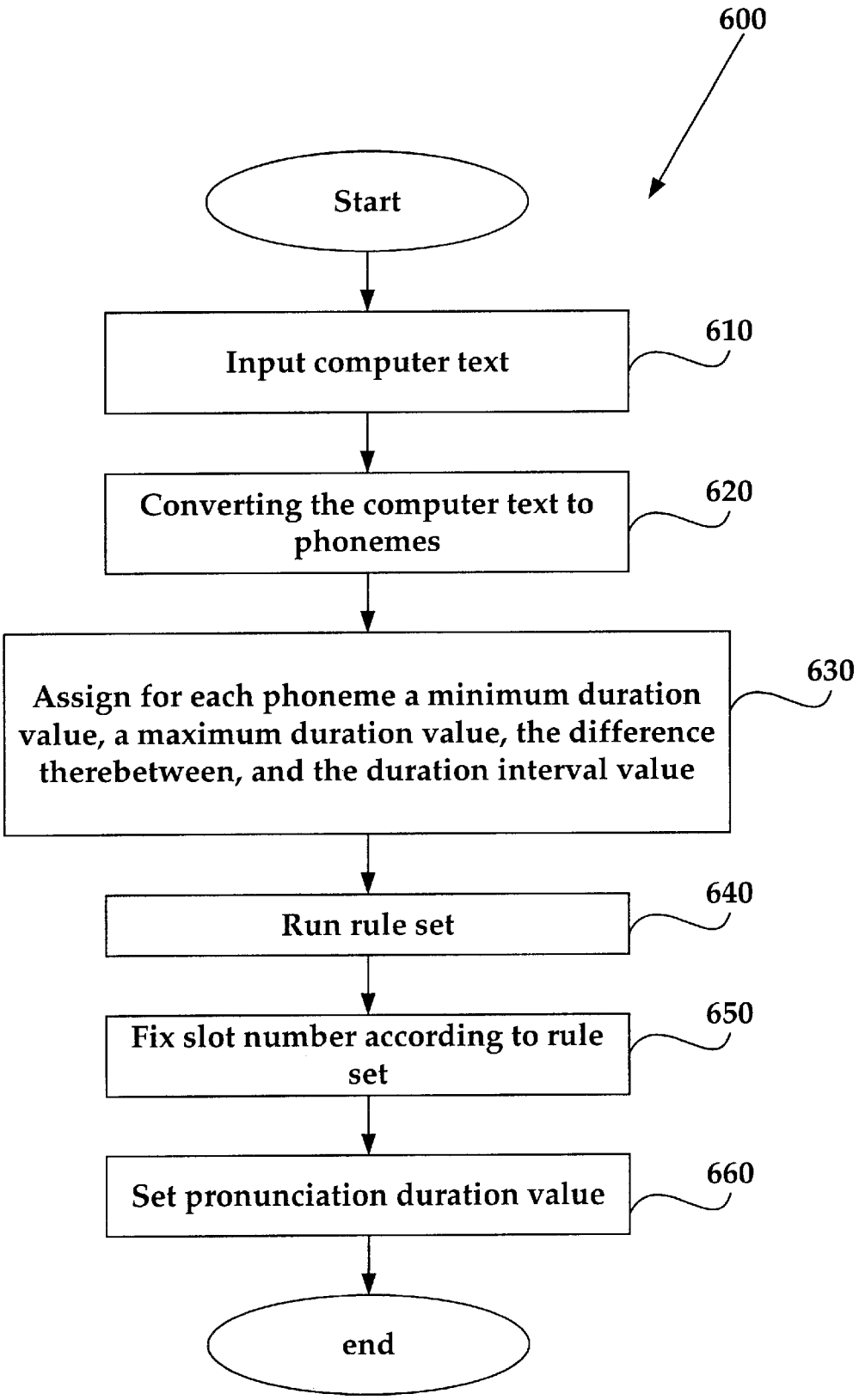
FIG. 6 is a flowchart illustrating a method for computing the phonetic sound pronunciation duration value.

FIG. 6 is a flowchart illustrating a method 600 for computing the phonetic sound pronunciation duration value. Method 600 begins in step 610 with CPU 30 inputting computer text from computer text memory 310. CPU 30 in step 620 converts computer text to phonemes, for example, using phoneme lookup table 330. CPU 30 in step 630 assigns, also from phoneme lookup table 330, duration value data 415 which includes minimum duration value 420, maximum duration value 430, difference value 440 and duration interval value 450. CPU 30 in step 640 runs duration rule set 350 to determine if the retrieved phonemes satisfy any of duration rules 510. CPU 30 in step 650 fixes slot numbers 520 according to duration rule set 350. CPU 30 in step 660 sets the phonetic sound pronunciation duration value, preferably by adding together the slot values of the satisfied duration rules, multiplying the sum by the duration interval value, and adding the product to the minimum duration value, and limiting the pronunciation duration value to maximum duration value 430. Method 500 then ends.

Finally, note that the two-stage operation innovation of the preferred embodiment of the present invention, as was described more fully herein, could be applied to the prior approach as well to the present approach.

The present invention has been described above by way of only one example, but it should be clear that this example is intended to be merely illustrative and not as defining the scope of the invention. Such modifications and variations of the embodiments of the present invention described above, that may be apparent to a person skilled in the art, are intended to be included within the scope of this invention.

04860.P890

APPENDIX A

For the duration calculation rules, in the preferred embodiment of the present invention, the following conditions are examined for each phonetic symbol:

phonetic symbol identity (this determines MIN/MAX, etc.)
vocalic (vowel)?
consonant?
in syllable rime?
in monosyllable word?
0-stress? (note: this is a term well known in the art and is indicated by the table look-up)
1-stress? (note: this is a term well known in the art and is indicated by the table look-up)
2- stress? (note: this is a term well known in the art and is indicated by the table look-up)
in a word generated from a 'symbol' (e.g. "%")?
left context for vowels:
    vowel?
    plosive?
right context for vowels:
    voiced fricative?
    voiced plosive?
    nasal?
    unvoiced plosive?
    in open syllable (syllable end with vowel)?
left context for consonants:
    consonant?
right context for consonants:
    consonant?
    vowel?
word final?
phrase final?
clause final?
emphasized? (note: as is well known in the art, many text-to-speech systems incorporate an emphasis marker whereby portions of the input text can marked for particular emphasis. The present invention thus takes into account the presence of any of these emphasis markers when determining the attributes of the relevant phonetic symbols and determining the duration value thereof.)
current system 'rate' setting (in words per minute)

04860.P890

An example of rule code that implements one of the rule sets that examine these features is given below:

```
//
// Initialize slot number variable
//
slot = 0;
//
// Rules for a vowel in a monosyllabic word
//
if ((Rxdff & drInPolySyllWord) != drInPolySyllWord)
{
        //
        // natural utterance with fast rate
        //
        if ((xintFeat & inInf) &&
                (gp->proscbA->Rate_package > 100))
        {
                MINDUR = MINDUR / 2;
                MAXDUR = MINDUR;
        }
        //
        // 0-stress
        //
        if (Rxdff & drStress0)
        {
                if (Rate_package < 120) slot = 6;
        }
        //
        // 1-stress
        //
        else if ((xdurFeat & drStress1) == drStress1) slot =4;
        //
        // 2-stress
        //
        else if ((xdurFeat & drStress2) == drStress2) slot =3;
        //
        // Monosyllabic verbs get lessened duration
        //
        if (((xintFeat & inVerb) == inVerb) &&
                        ((xintFeat & drClauseFinal) != drClauseFinal))
                        slot =4;
}
```

Copyright 1991, 1992 Apple Computer, Inc.

04860.P890

APPENDIX B

```
/*==========================*/
/* Normalize rate values    */
/*==========================*/

if (gp->proscbA->Rate_package < 1) gp->proscbA->Rate_package = allo_min_rate;
else if (gp->proscbA->Rate_package > 750) gp->proscbA->Rate_package = allo_max_rate;
prevrate = allo_default_rate;
Rpcb = gp->proscbA;
Rxsb = Rpcb->xsegBase;

/*==============================================================*/
/* Do all the duration rules, for each segment in turn          */
/*==============================================================*/

curx = &Rxsb[i];
Rxdff = curx->xdurFeat;

/*==================================================================================*/
/* Set special pause-allowed flag for word final allos (to get Classic to break nicely)  */
/*==================================================================================*/

if (curx->xFeat & afWORDI) curx->xIsilenceDur = WordInitialAllo;
templong = Rxsb[i].xinterCode * 3;
mindur = *(Rpcb->allophoneMinDur + templong);
inhdur = *(Rpcb->allophoneMinDur + templong + 1);
maxdur = *(Rpcb->allophoneMinDur + templong + 2);
prcnt = 100;
prcnt1 = 100;
pad = 0;

/*-----------------------------------------------*/
/* Vowels (and sonorant syllable heads) */
/*-----------------------------------------------*/

if ((curx->xdurFeat & drVowel) == drVowel)
{
        /*-----------------------------*/
        /* In monosyllabic word */
        /*-----------------------------*/

        if ((Rxdff & drInPolySyllWord) != drInPolySyllWord)
        {
                if ((curx->xintFeat & inInf) && (gp->proscbA->Rate_package > 100))
                {
                        mindur = mindur / 2;
                        maxdur = mindur;
                }

                /*==========*/
                /* 0-stress */
                /*==========*/

                if (Rxdff & drStress0)
                {
                        if (gp->proscbA->Rate_package < 120) pad += 6;
                }

                /*----------*/
```

04860.P890

```
            /* 1-stress*/
            /*----------*/

            else if ((curx->xdurFeat & drStress1) == drStress1) pad = 4;

            /*----------*/
            /* 2-stress */
            /*----------*/

            else if ((curx->xdurFeat & drStress2) == drStress2) pad = 3;

            /*-----------------------------------------------------*/
            /* Monosyllabic verbs get lessened duration */
            /*-----------------------------------------------------*/

            if (((curx->xintFeat & inVerb) == inVerb) &&
                    ((curx->xintFeat & drClauseFinal) != drClauseFinal))
            pad = 4;
    }

    /*----------------------------*/
    /* In polysyllabic word */
    /*----------------------------*/
            else
    {

            /*==========*/
            /* 0-stress      */
            /*==========*/

            if (Rxdff & drStress0)
            {
                    if (gp->proscbA->Rate_package < 120) pad += 5;
            }

            /*-----------*/
            /* 1-stress */
            /*-----------*/

            else if ((curx->xdurFeat & drStress1) == drStress1) pad += 4;

            /*----------*/
            /* 2-stress */
            /*----------*/

            else if ((curx->xdurFeat & drStress2) == drStress2) pad += 2;

            /*-----------------*/
            /* Word medial */
            /*-----------------*/

            if ((curx->xdurFeat & drInWordMedialSyll) == drInWordMedialSyll) pad -= 2;

            /*------------*/
            /* Word final */
            /*------------*/

            else if ((curx->xdurFeat & drInWordFinalSyll) == drInWordFinalSyll) pad += 1;
            }

    /*==================*/
    /* Vowel in a symbol        */
    /*==================*/
```

04860.P890

```
if (curx->xintFeat & inSymbol) pad += 9;

/*-------------------------*/
/* Vowel on left only */
/*-------------------------*/

if ((curx->xdurFeat & drLeftVowel) == drLeftVowel) pad -= 0;

/*---------------------------*/
/* Vowel on right only */
/*---------------------------*/

else if ((curx->xdurFeat & drRightVowel) == drRightVowel) pad += 2;

/*--------------------*/
/* Plosive on left */
/*--------------------*/

if (((curx->xdurFeat & drLeftVP) == drLeftVP) &&
        ((curx->xdurFeat & drStress0) != drStress0) &&
        ((curx->xdurFeat & drPostVocalicUP) != drPostVocalicUP)) pad += 1;

if (((curx->xdurFeat & drPhraseFinal) == drPhraseFinal) || ((curx->xdurFeat & drClauseFinal) ==
drClauseFinal))
{

        /*--------------------------------*/
        /* Voiced fricative on right */
        /*--------------------------------*/

        if ((curx->xdurFeat & drPostVocalicVF) == drPostVocalicVF)
        {

                if ((curx->xdurFeat & drStress1) == drStress1) pad += 3;
                else if ((curx->xdurFeat & drStress2) == drStress2) pad += 2;
                else if ((curx->xdurFeat & drStress0) == drStress0) pad += 1;
        }

        /*-----------------------------*/
        /* Voiced plosive on right */
        /*-----------------------------*/

        else if ((curx->xdurFeat & drPostVocalicVP) == drPostVocalicVP) pad += 1;

        /*-----------------*/
        /* Nasal on left */
        /*-----------------*/

        else if ((curx->xdurFeat & drPostVocalicNL) == drPostVocalicNL) pad -= 1;

        /*-----------------------------------------*/
        /* Open syllable (nothing on right) */
        /*-----------------------------------------*/

        else if ((curx->xdurFeat & drPostVocalicZero) == drPostVocalicZero)
        {
                pad += 3;
                if (((curx->xdurFeat & drStress1) == drStress1) || ((curx->xdurFeat & drStress0) ==
drStress1)) pad += 5;
        }

        /*--------------------------*/
        /* Unvoiced plosive on right */
```

04860.P890

```
                /*-----------------------------*/

                else if ((curx->xdurFeat & drPostVocalicUP) == drPostVocalicUP) pad -= 1;

                /* Liquid on left */

                else pad -= 2;
        }
        else
        {

                /*-----------------------------*/
                /* Voiced fricative on right */
                /*-----------------------------*/

                if (((curx->xdurFeat & drPostVocalicVF) == drPostVocalicVF) &
                        ((curx->xdurFeat & drStress0) != drStress0)) pad += 1;

                /*-----------------------------*/
                /* Voiced plosive on right */
                /*-----------------------------*/

                else if ((curx->xdurFeat & drPostVocalicVP) == drPostVocalicVP) pad += 1;

                /*---------------*/
                /* Nasal on left */
                /*---------------*/

                else if ((curx->xdurFeat & drPostVocalicNL) == drPostVocalicNL) pad -= 1;

                /*-----------------------------------*/
                /* Open syllable (nothing on right) */
                /*-----------------------------------*/

                else if ((curx->xdurFeat & drPostVocalicZero) == drPostVocalicZero)
                {
                        if ((curx->xdurFeat & drStress0) != drStress0) pad +=3;
                        else pad += 1;
                }

                /*-----------------------------*/
                /* Unvoiced plosive on right */
                /*-----------------------------*/

                else if ((curx->xdurFeat & drPostVocalicUP) == drPostVocalicUP) pad -= 1;

                /* Liquid on left */

                else pad -= 1;
        }

        /*---------------*/
        /* Phrase-final */
        /*---------------*/

        if ((curx->xdurFeat & drPhraseFinal) == drPhraseFinal)
        {
                if ((curx->xdurFeat & drStress1) == drStress1) pad += 1;
                else if ((curx->xdurFeat & drStress2) == drStress2) pad += 1;
                else if (((curx->xdurFeat & drStress0) == drStress0) && ((curx->xdurFeat & drInPolySyllWord) !=
drInPolySyllWord)) pad += 1;
        }
```

04860.P890

```
        /*--------------*/
        /* Clause-final */
        /*--------------*/

        else if ((curx->xdurFeat & drClauseFinal) == drClauseFinal)
        {
                if ((curx->xdurFeat & drStress1) == drStress1) pad += 3;
                else if ((curx->xdurFeat & drStress2) == drStress2) pad += 3;
                else if (((curx->xdurFeat & drStress0) == drStress0) && ((curx->xdurFeat & drInPolySyllWord) !=
drInPolySyllWord)) pad += 6;
                else pad += 2;
        }

        /*-----------------*/
        /* Emphasized vowel */
        /*-----------------*/

        if ((curx->xdurFeat & drEmph) == drEmph) pad += 3;

        /*--------------------*/
        /* De-emphasized vowel*/
        /*--------------------*/

        else if ((curx->xdurFeat & drDemph) == drDemph) pad -= 2;
}

/*------------*/
/* Consonants */
/*------------*/

else if ((curx->xdurFeat & drConsonant) == drConsonant)
{

        /*-------------------------*/
        /* Lengthen if word-initial */
        /*-------------------------*/

        if ((curx->xdurFeat & drWordInitial) == drWordInitial)
        {
                if ((curx->xdurFeat & drStress1) == drStress1)
                {
                        pad += 7;
                }
                else pad +=5;
        }

        /*--------------------*/
        /* Length for 1 stress */
        /*--------------------*/

        else if ((curx->xdurFeat & drStress1) == drStress1) pad +=2;

        /*-----------------------*/
        /* Lengthen if word final */
        /*-----------------------*/

        if ((curx->xdurFeat & drPostVocalicZero) == drPostVocalicZero) pad += 2;
        /* was 1 */

        /*--------------------------------*/
        /* Shorten in word medial position */
        /*--------------------------------*/
```

04860.P890

```
        if ((curx->xdurFeat & drInWordMedialSyll) == drInWordMedialSyll) pad -= 3;

        /*-----------------------------------------------------------*/
        /* Lengthen if 1-stress prevocalic sonorant (nasals not included) */
        /*-----------------------------------------------------------*/

        if ((curx->xdurFeat & drWordInitial) == drWordInitial)
        {
                if ((curx->xdurFeat & drStress1) == drStress1) pad += 1;
        }

        /*-----------------------------*/
        /* Prevocalic sonorant shortening */
        /*-----------------------------*/

        else if ((curx->xdurFeat & drPreVocalic) == drPreVocalic) mindur = mindur / 2;

        /*-----------------------------------------*/
        /* Adjust for segmental context (clusters) */
        /*-----------------------------------------*/

        if (((curx->xdurFeat & drLeftCons) == drLeftCons) &&
                ((curx->xdurFeat & drLeftCons) == drLeftCons))
        {
                pad -= 3;
        }
        else if ((curx->xdurFeat & drLeftCons) == drLeftCons)
        {
                pad -= 3;
        }
        else if ((curx->xdurFeat & drRightCons) == drRightCons)
        {
                pad -= 3;
        }

        /*-----------------------------------------------------*/
        /* Phrase- and clause- final lengthening for rime segments */
        /*-----------------------------------------------------*/

        if ((curx->xdurFeat & drInRime) == drInRime)
        {
                if ((curx->xdurFeat & drPhraseFinal) == drPhraseFinal)
                {
                        pad += 2;
                }
                if ((curx->xdurFeat & drClauseFinal) == drClauseFinal)
                {
                        pad += 6;                       /* was 4 */
                }
        }
}

/*=================================*/
/* Do intermediate calculation */
/*=================================*/

if (pad < 0) pad = 0;
if (pad > 9) pad = 9;

range = (maxdur - mindur) / 10;
pad = pad * range;
dur = mindur + pad;
if (dur < mindur) dur = mindur;
```

04860.P890

```
/*==========================================================================*/
/* Add or subtract 10% of calculated duration for every '>' or '<' marker sign found before the allophone */
/*==========================================================================*/

if (curx->xphmark_dur != 0)
{
        amark = abs(curx->xphmark_dur) * 10;
        if (curx->xphmark_dur < 0) dur -= (dur * amark) / 100;
        else if (curx->xphmark_dur > 0) dur += (dur * amark) / 100;
}

/*==================*/
/* Set final duration */
/*==================*/

if ((dur > maxdur) && ((curx->xdurFeat & drEmph) != drEmph)) dur = maxdur;

/*==============*/
/* Do rate scaling */
/*==============*/

rate_diff = 0;
if (curx->crate != prevrate) ratescale( &rate_diff, &prevrate, curx->crate);
if (rate_diff != 0) dur += (dur * rate_diff) / 100;

/*==================================*/
/* Assign final duration, with safety checking */
/*==================================*/

if (dur < 20) dur = 20;
if (dur > 400) dur = 400;
curx->xDuration = dur;
```

Copyright 1991, 1992 Apple Computer, Inc.

What is claimed is:

1. A system for computing phonetic sound pronunciation duration values, comprising:

computer text memory storing computer text;

phoneme memory storing phonemes representing pronunciation of said text and, corresponding to each of said phonemes, duration value data including a minimum duration value, a maximum duration value, the difference value between the maximum duration value and the minimum duration value, and a duration interval value which is defined in terms of a predetermined number of duration value intervals;

duration rule memory storing duration rules and corresponding duration modification values, each duration modification value being defined in terms of the predetermined number of duration value intervals; and a processor, coupled to the computer text memory, the phoneme memory and the duration rule memory, for using the duration rules to test the phonemes representing the computer text to determine if any of the duration rules are satisfied and for computing a pronunciation duration value based on modification values of satisfied duration rules.

2. The system of claim 1, wherein the duration interval value is one-tenth of the difference value.

3. The system of claim 1, wherein the processor computes the pronunciation duration value by multiplying the sum of the modification values of the satisfied duration rules by the duration interval value and adding the product to the minimum duration value.

4. The system of claim 3, wherein the processor limits the pronunciation duration value to the maximum duration value.

5. The system of claim 1, wherein the phoneme memory stores a phoneme lookup table including the phonemes and the duration value data.

6. The system of claim 5, wherein the phoneme lookup table further includes text-to-phoneme data.

7. A system for computing phonetic sound pronunciation duration values, comprising:

means for obtaining computer text from a computer text memory;

means for retrieving, from a phoneme memory, phonemes representing pronunciation of the computer text;

means for retrieving for each retrieved phoneme, from said phoneme memory, duration value data including a minimum duration value, a maximum duration value, the difference value between the maximum duration value and the minimum duration value, and a duration interval value which is defined in terms of a predetermined number of duration value intervals;

means for using duration rules stored in a duration rule memory to test the phonemes representing the computer text to determine if any of the duration rules are satisfied;

means for retrieving, from the duration rule memory, duration modification values corresponding to satisfied duration rules, each duration modification value being defined in terms of the predetermined number of duration value intervals; and means for computing a pronunciation duration value based on the duration modification values of satisfied duration rules.

8. The system of claim 7, wherein the duration interval value is one-tenth of the difference value.

9. The system of claim 7, wherein the means for computing computes the pronunciation duration value by multiplying the sum of the modification values of the satisfied duration rules by the duration interval value and adding the product to the minimum duration value.

10. The system of claim 9, wherein the means for computing limits the pronunciation duration value to the maximum duration value.

11. A computer-readable storage medium storing program code for causing a computer to perform the steps of:

obtaining computer text from a computer text memory;

retrieving, from a phoneme memory, phonemes representing pronunciation of the computer text;

retrieving for each retrieved phoneme, from said phoneme memory, duration value data including a minimum duration value, a maximum duration value, the difference value between the maximum duration value and the minimum duration value, and a duration interval value which is defined in terms of a predetermined number of duration value intervals;

using duration rules stored in a duration rule memory to test the phonemes representing the computer text to determine if any of the duration rules are satisfied;

retrieving, from the duration rule memory, duration modification values corresponding to satisfied duration rules, each duration modification value being defined in terms of the predetermined number of duration value intervals; and computing a pronunciation duration value based on the duration modification values of satisfied duration rules.

12. The medium of claim 11, wherein the duration interval value is one-tenth of the difference value.

13. The medium of claim 11, wherein the step of computing includes multiplying the sum of the modification values of the satisfied duration rules by the duration interval value; and adding the product to the minimum duration value.

14. The medium of claim 13, wherein the step of computing further includes limiting the pronunciation duration value to the maximum duration value.

15. A method for computing phonetic sound pronunciation duration values, comprising:

obtaining computer text from a computer text memory;

retrieving, from a phoneme memory, phonemes representing pronunciation of the computer text;

retrieving for each retrieved phoneme, from said phoneme memory, duration value data including a minimum duration value, a maximum duration value, the difference value between the maximum duration value and the minimum duration value, and a duration interval value which is defined relative to a predetermined number of duration value intervals;

using duration rules stored in a duration rule memory to test the phonemes representing the computer text to determine if any of the duration rules are satisfied;

retrieving, from the duration rule memory, duration modification values corresponding to satisfied duration rules, each duration modification value being defined relative to the predetermined number of duration value intervals; and computing a pronunciation duration value based on the duration modification values of satisfied duration rules.

16. The method of claim 15, wherein the duration interval value is one-tenth of the difference value.

17. The method of claim 15, wherein the step of computing includes multiplying the sum of the modification values of the satisfied duration rules by the duration interval value; and adding the product to the minimum duration value.

18. The method of claim 17, wherein the step of computing further includes limiting the pronunciation duration value to the maximum duration value.

* * * * *